United States Patent [19]

Pitt

[11] 3,956,981

[45] May 18, 1976

[54] METHOD FOR REFUSE DISPOSAL

[75] Inventor: Norman Pitt, Los Angeles, Calif.

[73] Assignee: John N. Valianos, San Francisco, Calif.

[22] Filed: Jan. 29, 1974

[21] Appl. No.: 437,689

[52] U.S. Cl. ..... 100/39; 100/41; 100/75; 100/97; 100/145; 264/176 R; 425/202

[51] Int. Cl.[2] ..... B30B 13/00

[58] Field of Search ..... 100/39, 41, 94, 96–97, 100/145, DIG. 3, 70–75; 241/22, DIG. 33; 259/148; 425/376, 467, 202; 53/21; 264/176 R, 101

[56] References Cited

UNITED STATES PATENTS

| | | | |
|---|---|---|---|
| 2,763,202 | 9/1956 | Gramelspacher | 100/71 X |
| 3,485,905 | 12/1969 | Compa | 425/202 |
| 3,547,577 | 12/1970 | Lovercheck | 100/70 X |
| 3,654,048 | 4/1972 | Bathgate | 53/21 |
| 3,666,847 | 5/1972 | Bailey | 425/379 |
| 3,683,796 | 8/1972 | Miner | 100/39 |
| 3,721,183 | 3/1973 | Dunlea | 100/39 |
| 3,790,091 | 2/1974 | Law | 100/39 |

*Primary Examiner*—Billy J. Wilhite

*Attorney, Agent, or Firm*—Fulwider Patton Rieber Lee & Utecht

[57] ABSTRACT

Refuse is processed for land fill use by comminuting the refuse into smaller particles, blending the comminuted refuse to form an extrudable mass and continuously extruding the mass through a constricted die to form high-density, low-volume shapes which are suitable for burying in a land fill.

Apparatus for carrying out the process includes at least one reduction mill, a blender having a shaft carrying radially extending pitched paddles for kneading and blending the comminuted refuse into an extrudable mass and an extruder carrying a constricted die and having a screw feed for continuously extruding the blended refuse to form high-density, low-volume shapes. The bore of the constricted die defines an outwardly tapered land adjacent the discharge end for controllably accommodating the normal expansion of the compressed refuse shape prior to leaving the die.

6 Claims, 2 Drawing Figures

METHOD FOR REFUSE DISPOSAL

BACKGROUND OF THE INVENTION

This invention relates to waste product disposal methods, and more particularly to method for compacting refuse into substantially low-volume, high-density forms which are then subsequently disposed of by burying in land fills and the like.

In recent years, the handling and disposal of refuse, particularly on a municipal level, has received much attention and study. Numerous suggestions regarding handling of refuse have been put forth and these suggestions range from incineration to various methods of land fill management. The least expensive, and most easily managed method to date for handling and disposing of refuse involves the use of land fills wherein the refuse is buried. The major advantage of this method of refuse handling is that unsuitable portions of land can be converted to useful land sites by virtue of their being used as a land fill for refuse disposal.

A major criticism of land fills, particularly raised by adjoining landowners, resides in the mess caused when refuse is trucked into and dumped in the land fill. Also, if improperly handled, land fills can give off noxious odors and will attract undesirable pests, such as rats.

A solution to many of the problems associated with land fills lies in the precompacting of the refuse. In this manner, the refuse can be reduced in volume, thereby to conserve on land fill usage, and the undesirable mess caused by newspapers and the like in the land fill and the attraction of pests may be avoided.

Devices are known in the prior art for compacting comminuted refuse. See, for example, U.S. Pat. No. 3,426,673, Miner, et al. However, these devices are not practical for use by most municipalities because of their limited refuse-handling capacity and mechanical unreliability.

OBJECTS OF THE INVENTION

In accordance with the present invention, there is provided a method for carrying out the method for compacting refuse into easily handled, low-volume, high-density forms. Refuse can be handled in accordance with the present invention on a substantially continuous basis and in sufficiently large quantities so as to be useful for municipal refuse-handling systems.

In accordance with the method of this invention, refuse is comminuted to form smaller particles which are then blended to form a mass of compactable and extrudable consistency. The blended mass is extruded through a constricted die to compact and extrude the mass into a shape having a volume substantially less than the original volume of the refuse material.

Where desired, a classification step may be included between the comminuting and blending steps for the purpose of removing glass, and other heavy metallic and non-metallic components from the refuse.

More specifically, the comminution step is carried out in one or more reduction mills which serve to reduce raw refuse into smaller size particles. The comminuted refuse is transported to a blender where it is worked into an extrudable, compactable mass having a controlled moisture content. The blended mass is extruded into compact shapes by extruding the blended mass through a constricted die where the mass passing therethrough is compacted and then allowed to expand slightly before leaving the die. The extruded refuse leaves the die in a substantially continuous body which subsequently is broken into convenient lengths for handling. The low-volume, high-density shapes thus formed are hauled to a land fill area and buried.

Further features and advantages of the present invention reside in the specific configuration of the extruding die; in the relationship between the internal diameter of the in-feed end of the die and the internal diameter of the extruder barrel through which the blended mass is fed to the die; and in the provision of means for maintaining the blended mass at subatmospheric pressures to aid in the removal of entrained air therefrom. Other features and advantages of the present invention will become apparent from the following detailed description, taken in conjunction with the accompanying drawings, which illustrate, by way of example, the principles of the invention.

DETAILED DESCRIPTION

Figure 1:
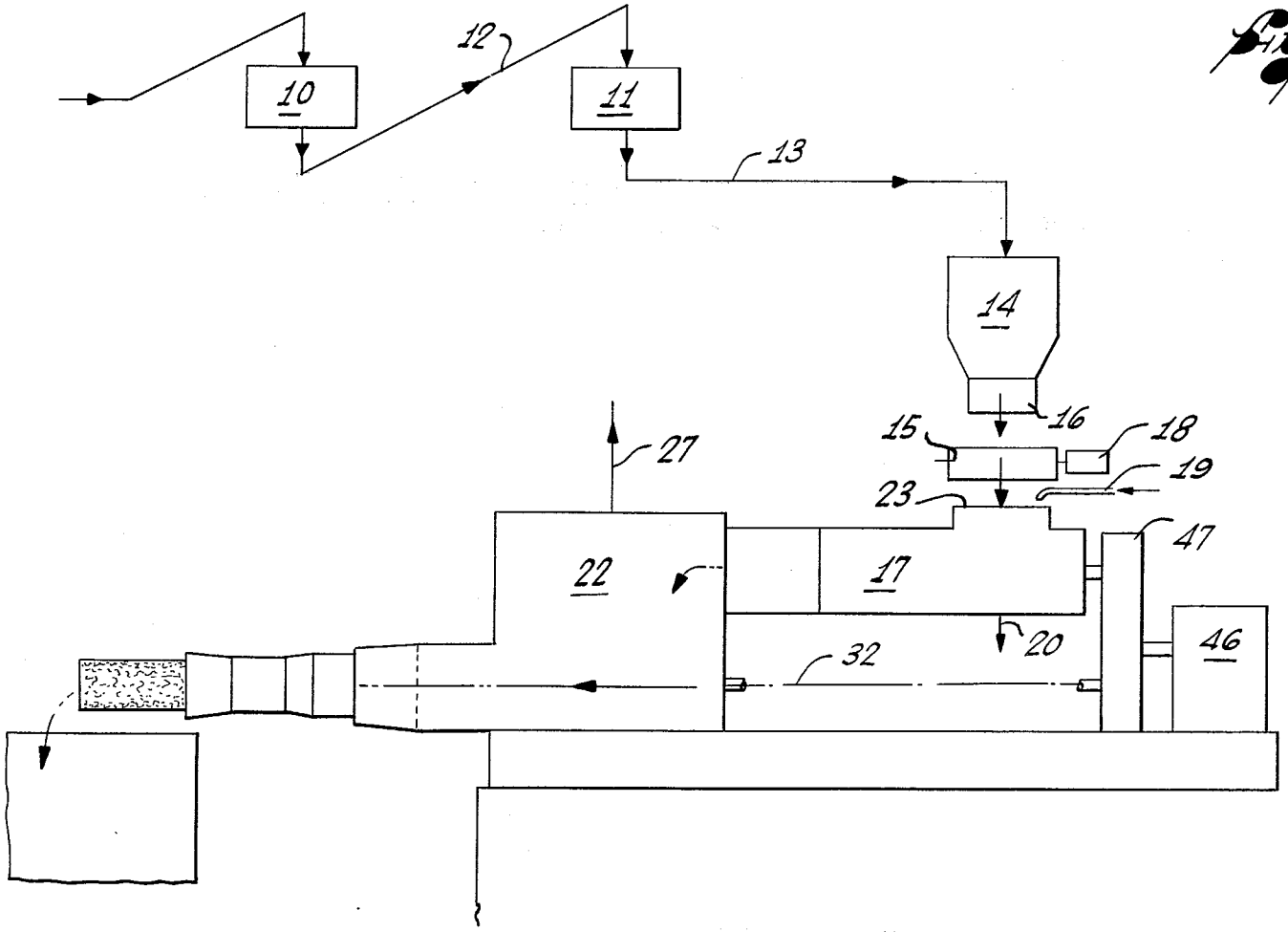
FIG. 1 is a schematic diagram illustrating the flow of refuse as it is processed in accordance with the present invention.

Referring to the drawings wherein like reference characters refer to like parts throughout the several figures, the present invention is embodied in an improved method for processing and compacting refuse. Refuse may be processed continuously or intermittently, although the method of the present invention are particularly suited for high capacity, continuous operation. As processed in accordance with the present invention, the processed refuse is in the form of low-volume, high-density bodies comprising comminuted compacted particles of refuse which bodies retain their shape through normal handling, and can be buried directly in a land fill or the like, without any subsequent processing. When processed in accordance with this invention, large amounts of refuse can be handled and disposed of in a minimum of land fill area.

As used herein, refuse includes the waste materials generated by the normal municipality and will include organic and inorganic materials in various combinations. In addition to discarded fruit, vegetable, paper and meat products, refuse may also include textile materials, metal cans, glass bottles, wood products and the like. In addition, depending on the day of pick-up and the locality, refuse may contain high proportions of grass cuttings, leaves, tree limbs, and the like, and, depending on weather conditions, the refuse treated may be dry or wet.

As is more specifically shown in FIG. 1, raw refuse is first passed through one or more reduction mills, such as represented by reduction mills 10 and 11, for comminution of the raw refuse into smaller particles. The reduction mills are series connected by conventional conveying means represented schematically as line 12. Conventional reduction mills, such as of the impact type, are utilized. The particle size of the comminuted waste material is not critical to the process of the present invention, and depending upon the nature of the material being comminuted, the comminuted refuse may also be described as being shredded.

Following the comminution operation, the comminuted refuse is led by conveyor belt or other suitable means, shown schematically as line 13, to a hopper 14 where it is held for subsequent processing. Optionally, the comminuted refuse may be first subjected to a separation process, such as air classification or separation, to remove glass, and other heavy nonmetallic and metallic materials from the refuse for subsequent salvage and re-cycling.

The comminuted refuse is discharged from the hopper 14 onto a variable speed belt conveyor 15 for transport to a blender 17. A multi-position gate 16 is located adjacent the discharge port of the hopper 14 for control of the quantity of refuse transported to the blender 17. The speed of the belt conveyor 15, which is preferably driven by an electric motor (not shown), is controlled and variable so that the rate of flow of comminuted refuse to the blender 17 is also controlled. Suitable control means are represented schematically by the control box 18.

The blending step consists of a kneading and blending operation whereby the particles of comminuted refuse are worked and blended together to form an extrudable mass. The moisture content of the mass is important, and it has been found that if the moisture content is too low or too high, the comminuted refuse will not be properly blended and will not have the proper consistency for efficient extrusion. Best results are obtained when the moisture content of the blended mass is maintained between about 15 to about 25% by weight of the blended mass. Preferably, the moisture content is maintained at between 18 to 23% by weight of the blended mass. Although normally sufficient amounts of moisture are available in the refuse to provide the blended mass with the proper moisture content, in certain cases moisture addition will be required, and in such a case, water may be added as at 19 during the blending operation. Likewise a drain 20 is provided to remove excess water in the event the comminuted refuse is high in moisture content.

It has been found that the addition of minor amounts of clay to the refuse during the blending operation will materially improve the blending and extruding operations. It is believed that the clay acts both as a lubricant and as a binder for the extruded and compacted refuse. Any suitable clay material may be utilized, such as for example, kaolin, ball clay, fire clay, bentonite, fuller's earth, and the like. The blended mass may comprise up to 10% by weight of the clay additive with good results.

The blender 17 is of conventional design and comprises an elongated container having a driven shaft 21 (FIG. 2) extending longitudinally through the interior of the container. The shaft carries a plurality of radially extending pitched paddles (not shown) for kneading and mixing the comminuted refuse. The blender 17 communicates with an extruder 22 at one end and comminuted refuse is introduced through an entry port 23 in the opposite end. Responsive to the action of the pitched paddles, the comminuted refuse is kneaded blended and moved longitudinally through the blender 17 toward the extruder 22. The end of the shaft adjacent the extruder 22 is provided with a helical flange 24 defining a screw for the continuous feeding of the blended refuse from the blender 17 to the extruder 22.

The blended mass is charged to the extruder 22 for extrusion through a constricted die, shown generally as 26. In the preferred practice of the method of the present invention, the extruder 22 is connected to a vacuum pump, not shown, by means of line 27 for maintaining the interior of the extruder 22 at a reduced pressure. In this manner, at least a portion of air entrained in the blended mass is removed, which aids in eliminating voids in the extruded form.

The method of this invention are designed primarily for continuous operation. When fully on stream, the compacted refuse is continuously exiting from the constricted die 27 as an elongated rod or log 28. Cutting means, not shown, may be provided to divide the extruded log into lengths convenient for handling. It has been found, however, that such cutting means are not required, and that the extruded log will break by its own weight into lengths ranging from 1 to 12 inches, which are convenient lengths for handling purposes.

Figure 2:
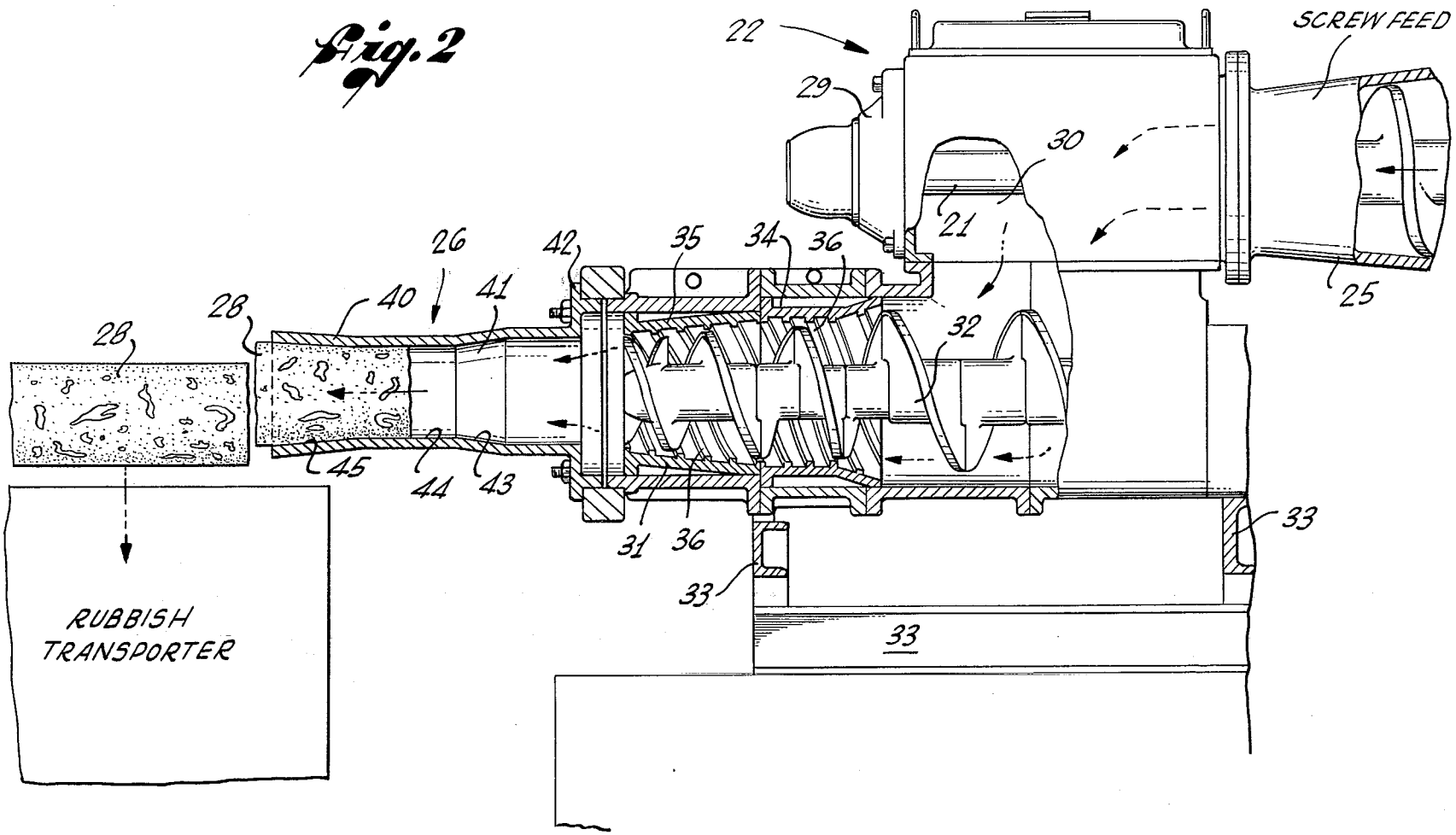
FIG. 2 is an enlarged scale side view, partly in section, ot the extrusion portion of the apparatus of the present invention.

As is more specifically shown in FIG. 2, the extruder 22 comprises an enclosed chamber 30 which is in communication with the barrel 25 of the blender 17 for receiving the blended mass. Shaft 21 extends through the upper portion of the chamber 30 and is journaled at 29. An extruder barrel 31 extends from the lower portion of the chamber 30 for communication between the chamber 30 and the constricted die 26. A driven extruder screw shaft 32 having a decreasing diameter and decreasing pitch extends through the lower portion of the chamber 30 and through the length of the extruder barrel 31 for moving the blended, extrudable refuse from the chamber 30 through the constricted die 26.

The extruder 22 is supported on a surface by channel-shaped frame members 33.

The extruder barrel 31 defines a feed section 34 in communication with the chamber 30 and extending through a portion of the extruder barrel 31, and a metering section 35 of decreasing internal diameter extending from the feed section 34 to the constricted die 26 for communication therewith.

The feed section 34 of the extruder barrel 31 is flared at the end adjacent the chamber 30 for the streamlined flow of blended refuse from the chamber 30 through the extruder barrel 31. A major portion of the internal diameter of the feed section 34, however, is constant as shown.

The metering section 35 decreases in internal diameter from the feed section 34 to the constricted die 26 and provides some initial compaction of the refuse prior to entering the constricted die 26. The diameter of the screw portions of the shaft 32 contained within the extruder barrel 31 is likewise decreased to accommodate its extension within the feed section 34 and the metering section 35 of the extruder barrel 31. The interior walls of the extruder barrel 31 are provided with helical ribs 36 which aid in moving the refuse through the extruder barrel 31 responsive to the rotation of the screw shaft 32.

The constricted die 26 comprises an open-ended tubular member 40, the interior of which defines the die bore 41, and which is provided at one end with an annular flange 42 for mounting the constricted die 26 on the end of the extruder barrel 31 with the bore 41 aligned and communicating with the interior of the extruder barrel 31. A portion of the bore 42 adjacent the in-feed end of the constricted die 26 defines an inwardly tapered land 43 which leads to a portion of the bore 41 defining a constricted land 44, which represents the point of greatest compaction within the die 26. Adjacent the discharge end of the constricted die 26, the bore 41 defines an outwardly tapered land 45 which extends from the constricted land 44 to the discharge end of the constricted die 26.

As seen in FIG. 2, material entering the bore 41 of the constricted die 26 is initially held at the in-feed end at substantially the same cross-sectional areas as when it left the metering section 35 of the extruder barrel 31. As the material continues through the constricted die 26 it is gradually compacted by the inwardly tapered land 43 until it reaches the constricted land 44 which is the point of greatest compaction of the material in the constricted die 26. As with most materials, the compacted refuse expands upon release of the compressive force, and such expansion, if uncontrolled, can result in a weakening of the extruded form. The outwardly tapered land 45 provides a gradual release of the compressive force generated by the constricted land 44 and controllably allows the shape to expand as it passes through the outwardly tapered land 45. In this manner, undue weakening of the extruded forms by expansion and loss of density by over-expansion of the extruded form are substantially avoided.

To maintain the high refuse processing capacity of the process of the present invention, certain dimensional relationships have been found to be very important. It has been found that best results are obtained when the ratio of the internal diameter of the bore 41 at the in-feed end of the constricted die 26 to the internal diameter of the feed section 34 of the extruder barrel 31 interiorly of the flanged area is maintained at between 0.65:1 and 0.85:1. It is also highly preferred to maintain the ratio of the internal diameter of the constricted land 43 to the internal diameter of the bore 41 at the in-feed end of the constricted die 26 at 0.923:1. This figure, however, can be varied by lengthening or shortening the inwardly tapering land 43.

As is best shown in FIG. 1, both the blender shaft 21 and the extruder screw shaft 32 are driven from a common drive motor 46 and conventional gear means, not shown, contained in gear box 47. If desired, however, each of the shafts 21 and 32 can be separately driven, such as in the case where the blender 17 and the extruder 22 are not in line.

In accordance with the foregoing description, the method of the present invention provides for the high-capacity, continuous process for converting refuse into a form readily suitable for land fill use. The problems normally attendant with the burying of refuse in land fills, such as for example, loose refuse in the area, noxious odors, high land use, and the attraction of rodents and the like, are avoided by converting refuse into high-density, low-volume refuse shapes in accordance with the present invention. For example, refuse having a density ranging from 4 lbs/ft.$^3$ to 15 lbs/ft$^3$ is converted into an easily handled compacted shape having a density of 55 lbs/ft$^3$ to 65 lbs/ft$^3$. By the elimination of hydraulic rams and the like, the apparatus of the present invention has the ability to process refuse at a high rate economically and with mechanical reliability.

While a particular form of the invention has been illustrated and described, it will be apparent that various modifications can be made without departing from the spirit and scope of the invention.

I claim:

1. A method for processing waste material to substantially reduce the volume thereof, comprising the steps of:

passing said waste material through at least one reduction mill to communicate said waste material into small particles;

feeding said comminuted waste material at a controlled rate to a blender;

blending said comminuted waste material to form an extrudable mass and maintaining the moisture content of said extrudable mass between about 15 and about 25% by weight of the extrudable mass; and extruding said mass through a constricted die to compress said mass into a compact shape, the bore of said constricted die defining an outwardly tapered land adjacent the discharge end of said die whereby normal expansion of the compact shape after extrusion occurs prior to the discharge of the shape from said die.

2. The method of claim 1 further including the step of adding clay to said comminuted waste material during said blending step.

3. The method of claim 1 wherein up to 10% of weight of said extrudable means comprises clay.

4. The method of claim 1 wherein the moisture content of said extrudable mass is maintained at between about 15 and about 25% by weight of said extrudable mass.

5. The method of claim 1 wherein the moisture content of said extrudable mass is maintained at between 18 and 23% by weight of said extrudable mass.

6. The method of claim 1 wherein said extrudable mass is maintained at a reduced pressure prior to extrusion to remove at least a portion of entrained air therefrom.

* * * * *